United States Patent [19]

Perrotti

[11] 4,030,100

[45] June 14, 1977

[54] MULTIPURPOSE SUBMARINE ANTENNA

[75] Inventor: Emmanual Joseph Perrotti, Ramsey, N.J.

[73] Assignee: International Telephone and Telegraph Corporation, Nutley, N.J.

[22] Filed: Feb. 6, 1976

[21] Appl. No.: 655,812

[52] U.S. Cl. ..... 343/709; 343/725; 343/895

[51] Int. Cl.[2] ..... H01Q 1/34; H01Q 1/36

[58] Field of Search ..... 343/709, 710, 725, 895, 343/729

[56] References Cited

UNITED STATES PATENTS

| | | | |
|---|---|---|---|
| 2,987,721 | 6/1961 | Edwards et al. | 343/725 |
| 3,942,180 | 3/1976 | Rannou et al. | 343/725 |

*Primary Examiner*—Eli Lieberman
*Attorney, Agent, or Firm*—John T. O'Halloran; Alfred C. Hill

[57] ABSTRACT

An IFF antenna is disposed symmetrically about a vertical axis. A power divider and a pair of transmission lines are provided to symmetrically feed the IFF antenna. A GPS antenna is disposed coaxially of the vertical axis and above the IFF antenna. A gap is provided between the top of the IFF antenna and the bottom of the GPS antenna having a predetermined width. A three wire balun is disposed coaxially of the vertical axis and within the IFF antenna to feed the GPS antenna and a conductive shield is disposed coaxially of the vertical axis surrounding the three wire balun and interconnecting the IFF antenna and the GPS antenna for isolation therebetween.

18 Claims, 2 Drawing Figures

MULTIPURPOSE SUBMARINE ANTENNA

BACKGROUND OF THE INVENTION

This invention relates to antennas and more particularly to a multipurpose submarine antenna.

Multipurpose submarine antennas are constructed to handle several types of radiations simultaneously. As a result, these structures have a relatively high packing density and space within the structure is at a premium. In particular, one prior art submarine antenna contains as one of its radiators a short, linearly polarized "door knob" fat monopole to handle IFF (identification friend or foe) transmissions. There is no more room within the structure to fit an antenna to receive GPS (global positioning satellite) signals and to compound the problem, the GPS signals are circularly polarized. In addition, GPS transmissions require antenna coverage for all angles in the upper hemisphere extending from +20° to overhead. This means that even if one were willing to take the polarization loss of the present IFF antenna, the pattern loss would be prohibitive at high angles.

SUMMARY OF THE INVENTION

An object of the present invention is to provide a multipurpose antenna to provide simultaneous IFF and GPS antenna radiation to circumvent the problems mentioned hereinabove.

Another object of the present invention is to provide a multipurpose submarine antenna providing IFF and GPS antenna radiation without sacrificing gain due to pattern and/or polarization loss and to perform this in the same space now occupied by the prior art IFF antenna alone.

A feature of the present invention is the provision of a multipurpose submarine antenna comprising: an IFF antenna disposed symmetrically about a vertical axis; first means coupled to the IFF antenna to symmetrically feed the IFF antenna; a GPS antenna disposed coaxially of the vertical axis and above the IFF antenna; a gap having a predetermined width disposed between the top of the IFF antenna and the bottom of the GPS antenna; second means disposed coaxially of the vertical axis and within the IFF antenna to feed the GPS antenna; and a conductive shield disposed coaxially of the vertical axis surrounding the second means and interconnecting the IFF antenna and the GPS antenna for isolation therebetween.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
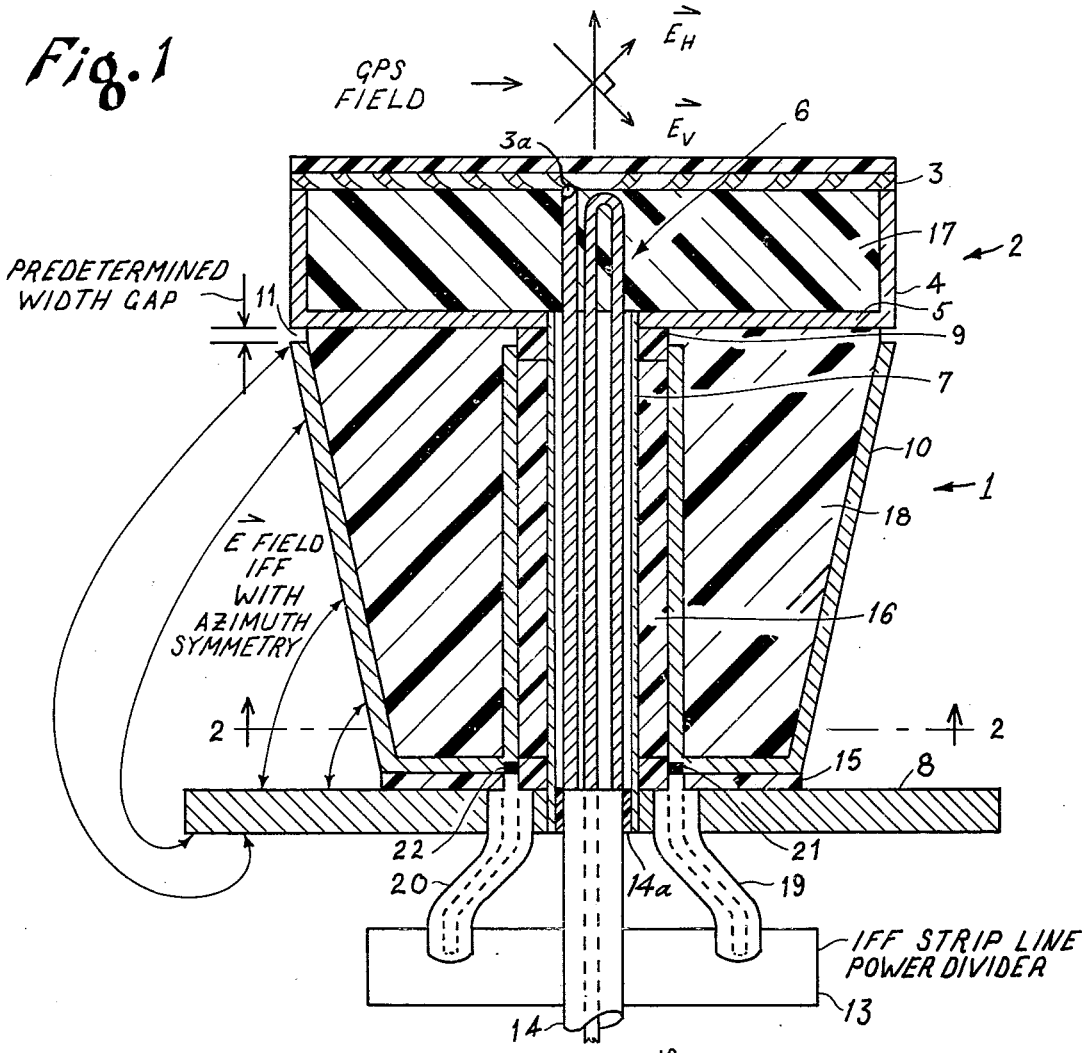
FIG. 1 is a cross-sectional view of a multipurpose submarine antenna in accordance with the principles of the present invention.

The linearly polarized IFF antenna 1 and the circularly polarized GPS antenna 2 are disposed symmetrically and coaxially about a vertical axis and arranged in a common structure. GPS antenna 2 is disposed above IFF antenna 1 and includes a flat ungrounded spiral 3 located in a cavity 4/ground plate 5 assembly to produce and receive circularly polarized radiation. Spiral 3 is centrally fed at connection 3a by a three wire balun 6 which incorporates a shield 7 (FIGS. 1 and 2) that connects ground plate 5 to the conducting plate 8 of IFF antenna 1. Shield 7 spaced from balun 6 forms part of the antenna isolation mechanism between the GPS antenna 2 and the IFF antenna 1.

A non-conducting standoff 9 is employed immediately below ground plate 5 of the GPS antenna 2 to prevent shorting the tapered split cylinder 10 (FIGS. 1 and 2) of IFF antenna 1 to ground plate 5. A gap 11 is provided between the GPS antenna 2 and the IFF antenna 1 to enable implementing a glassing process discussed hereinbelow and to aid in the IFF antenna matching. Once the width of the gap 11 has been predetermined, this width is fixed.

Figure 2:
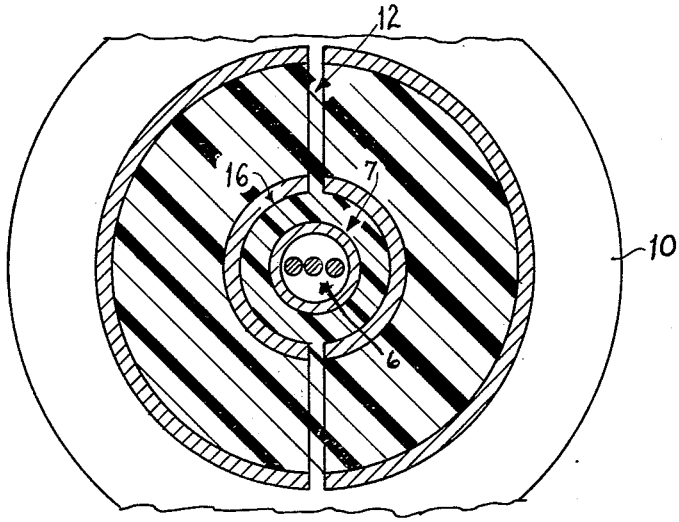
FIG. 2 is a cross-sectional view taken along line 2—2 of FIG. 1.

IFF antenna 1 includes a split tapered cylinder 10 (FIGS. 1 and 2) over a conducting plate 8 to produce and receive linearly polarized radiation. The split 12 of cylinder 10 is illustrated in FIG. 2. The reason for providing this configuration is because two in-phase feed points are required to symmetrically drive IFF antenna 1 in order to allow for three wire balun 6 to be located in its illustrated central position. The two symmetrical feed points 21 and 22 are driven in a balanced manner by the IFF strip line power divider 13 through transmission lines 19 and 20. The strip line construction of power divider 13 will allow the GPS transmission line 14 to pass through the center of power divider 13 if desired. Transmission line 14 is supported in plate 8 by a dielectric sleeve 14a. The split tapered cylinder 10 and conducting plate 8 are electrically isolated from each other by standoff 15. A non-conducting sleeve 16 (FIGS. 1 and 2) is provided between shield 7 and split tapered cylinder 10 to provide electrical isolation therebetween and, hence, electrical isolation between antennas 1 and 2.

In order to enable the multipurpose antenna structure of the present invention to operate in a free flooding environment, such as when the submarine dives, the combined structure is filled with a dielectric material 17 and 18, such as glass, and sealed to the respective metallic members of the multipurpose antenna structure by a process similar to that used to make glass to metal seals. The purpose of dielectric material 17 and 18 is to prevent the sea pressure during a submarine dive from forcing sea water into the antenna and transmission lines associated therewith. This is the glassing process mentioned above.

The driving point impedance for each arm of the power divider cannot be determined by any other means but actual measurement. A major reason for this is the fact that the base diameter of split cylinder 10 adjacent plate 8 is not negligible compared to the major diameter adjacent GPS antenna 2 and so there will be appreciable base capacitance. This is the reason for gap 11 previously mentioned. Since IFF antenna 1 is made approximately ¼ wavelength long, the gap capacitance can be adjusted (much as in transmission line matching) to negate the base capacitance since the capacitors are interconnected by balun shield 7.

While I have described above the principles of my invention in connection with specific apparatus it is to be clearly understood that this description is made only by way of example and not as a limitation to the scope of my invention as set forth in the objects thereof and in the accompanying claims.

I claim:

1. A multipurpose submarine antenna comprising:
an identification friend or foe (IFF) antenna disposed symmetrically about a vertical axis;
first means coupled to said IFF antenna to symmetrically feed said IFF antenna;
a global positioning satellite (GPS) antenna disposed coaxially of said vertical axis and above said IFF antenna;
a gap having a predetermined width disposed between the top of said IFF antenna and the bottom of said GPS antenna;
second means disposed coaxially of said vertical axis and within said IFF antenna to feed said GPS antenna; and
a conductive shield disposed coaxially of said vertical axis surrounding said second means and interconnecting said IFF antenna and said GPS antenna for isolation therebetween;
said GPS antenna including
a spiral radiator disposed coaxial of and perpendicular to said vertical axis, and
a cavity and ground plate disposed coaxial of said vertical axis and extending from and below said spiral radiator.

2. A submarine antenna according to claim 1, wherein
said GPS antenna is a circularly polarized antenna.

3. A submarine antenna according to claim 2, wherein
said IFF antenna is a linearly polarized antenna.

4. A submarine antenna according to claim 1, wherein
said IFF antenna is a linearly polarized antenna.

5. A submarine antenna according to claim 1, wherein
said first means includes
a power divider, and
a pair of transmission lines each coupled to said power divider and one of two symmetrically disposed points of said IFF antenna.

6. A submarine antenna according to claim 5, wherein
said power divider is a strip line power divider.

7. A submarine antenna according to claim 5, wherein
said second means includes
a single transmission line, and
a three wire balun coupled between said single transmission line and said GPS antenna.

8. A submarine antenna according to claim 1, wherein
said second means includes
a transmission line, and
a three wire balun coupled between said transmission line and said GPS antenna.

9. A submarine antenna according to claim 1, wherein
said GPS antenna further includes
a first dielectric material entirely filling the space defined by said spiral radiator, cavity and ground plate and sealed to the bottom of said sprial radiator, the inner surface of said cavity and ground plate and the outer surface of said second means disposed in said cavity.

10. A submarine antenna according to claim 9, wherein
said IFF antenna includes
a conductive plate disposed coaxial of and perpendicular to said vertical axis, and
a split tapered cylinder disposed in spaced relation with respect to said conductive plate and symmetrically with respect to said vertical axis, said tapered cylinder tapering from a point adjacent said ground plate toward said vertical axis adjacent said conductive plate.

11. A submarine antenna according to claim 10, wherein
said IFF antenna further includes
a first non-conducting standoff disposed between said conductive plate and the lower end of said tapered cylinder,
a non-conducting sleeve disposed coaxial of said vertical axis surrounding said conductive sleeve extending from said first standoff to a point adjacent said ground plate, and
a second non-conducting standoff coaxial of said vertical axis disposed between said sleeve and said ground plate to maintain said gap.

12. A submarine antenna according to claim 11, wherein
said first means includes
a power divider, and
a pair of transmission lines each coupled to said power divider and one symmetrical point on an associated half of said tapered cylinder adjacent said conductive plate.

13. A submarine antenna according to claim 12, wherein
said power divider is a strip line power divider.

14. A submarine antenna according to claim 13, wherein
said second means includes
a single transmission line, and
a three wire balun coupled between said single transmission line and the center of said spiral radiator.

15. A submarine antenna according to claim 14, wherein
said IFF antenna further includes
a second dielectric material entirely filling said tapered cylinder and said gap and sealed to the inner surface of said tapered cylinder and said ground plate.

16. A submarine antenna according to claim 1, wherein
said IFF antenna includes
a conductive plate disposed coaxial of and perpendicular to said vertical axis, and
a split tapered cylinder disposed in spaced relation with respect to said conductive plate and symmetrically with respect to said vertical axis, said tapered cylinder tapering from a point adjacent said GPS antenna toward said vertical axis adjacent said conductive plate.

17. A submarine antenna according to claim 16, wherein
said IFF antenna further includes
a first non-conducting standoff disposed between said conductive plate and the lower end of said tapered cylinder,
a non-conducting sleeve disposed coaxial of said vertical axis surrounding said conductive sleeve extending from said first standoff to a point adjacent said GPS antenna, and a second non-conducting standoff coaxial of said vertical axis disposed between said sleeve and said GPS antenna to maintain said gap.

18. A submarine antenna according to claim 17, wherein said IFF antenna further includes a dielectric material entirely filling said tapered cylinder and said gap and sealed to the inner surface of said tapered cylinder and said GPS antenna.

* * * * *